United States Patent [19]

Andersson

[11] Patent Number: 4,645,363

[45] Date of Patent: Feb. 24, 1987

[54] PIVOTALLY MOUNTED GUIDE MEANS IN ENDLESS RIBBON CASSETTES

[75] Inventor: Leif H. Andersson, Åtvidaberg, Sweden

[73] Assignee: Telefonaktiebolaget LM Ericsson, Stockholm, Sweden

[21] Appl. No.: 659,309

[22] PCT Filed: Mar. 6, 1984

[86] PCT No.: PCT/SE84/00079

§ 371 Date: Oct. 10, 1984

§ 102(e) Date: Oct. 10, 1984

[87] PCT Pub. No.: WO84/03475

PCT Pub. Date: Sep. 13, 1984

[30] Foreign Application Priority Data

Mar. 7, 1983 [SE] Sweden ..... 8301232

[51] Int. Cl.[4] ..... B41J 35/02

[52] U.S. Cl. ..... 400/196.1; 400/234; 400/248

[58] Field of Search ..... 400/194, 195, 196, 196.1, 400/207, 208, 208.1, 234, 248

[56] References Cited

U.S. PATENT DOCUMENTS

| | | | |
|---|---|---|---|
| 2,685,357 | 8/1954 | Koreska | 400/196.1 |
| 3,900,099 | 8/1975 | Hengelhaupt | 400/248 |
| 3,977,512 | 8/1976 | Teagarden et al. | 400/208 X |
| 4,003,460 | 1/1977 | Gray et al. | 40/248 X |
| 4,084,683 | 4/1978 | Moss | 400/248 X |
| 4,247,209 | 1/1981 | Carlson et al. | 400/195 |

OTHER PUBLICATIONS

IBM Technical Disclosure Bulletin, "Adjustable Ribbon Tracking Device", Lentz, vol. 16, No. 6, Nov. 1973, pp. 1751–1752.

IBM Technical Disclosure Bulletin," Compressible Ribbon Roller for Constant Tension," Craft, vol. 23, No. 10, Mar. 1981, pp. 4553–4554.

Xerox Disclosure Journal, "Uniform Ribbon Tension for Impact Printer Ribbon", Kockler et al, vol. 4, No. 2, Mar./Apr. 1979, pp. 181–182.

Xerox Disclosure Journal, "Multi-Track Ribbon Lift Control", Plaza, vol. 4, No. 3, May/Jun. 1979, p. 417.

*Primary Examiner*—Ernest T. Wright, Jr.

*Attorney, Agent, or Firm*—Roberts, Spiecens & Cohen

[57] ABSTRACT

A pivotal guide for changing the direction of a typing ribbon in typewriters such that when raising or lowering the ribbon at the printing location relative to the printing element, transverse forces are eliminated. The guide comprises a cylindrical body having a longitudinal slot which receives an end wall of the magazine, the bottom of the slot being formed with two projecting sloped surfaces which intersect midway of the body to form a pivot axis for the body on the edge of the end wall. The body has cylindrical end surfaces confined between cover plates of the magazine to limit axial movement of the guide body and the ribbon thereon.

6 Claims, 4 Drawing Figures

Fig. 3A
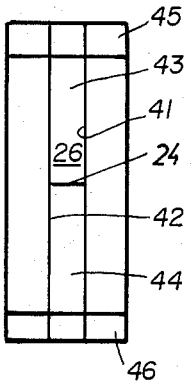
Fig. 3B
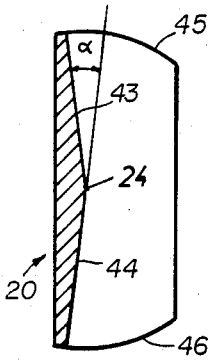
Fig. 3C
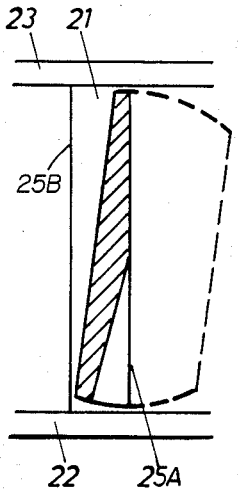
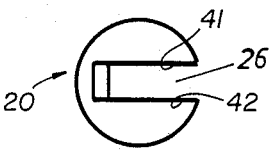
Fig. 3D
Fig. 4A
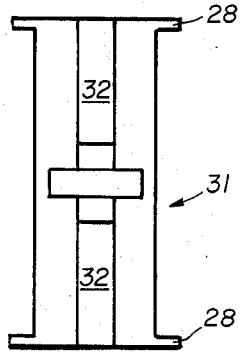
Fig. 4B
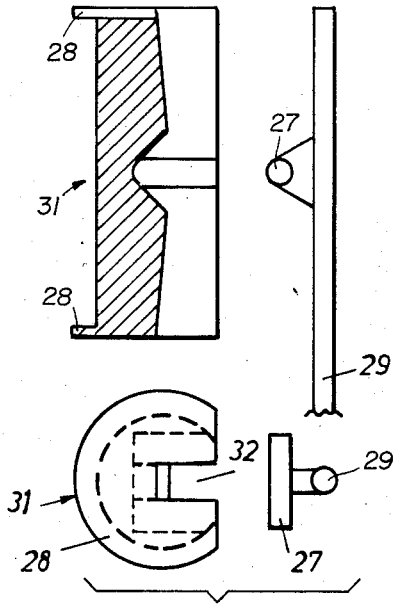
Fig. 4D
Fig. 4C
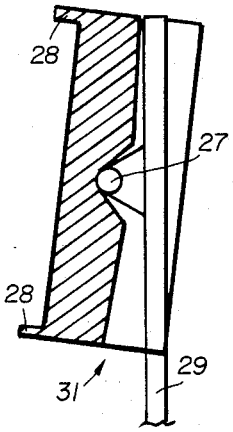

PIVOTALLY MOUNTED GUIDE MEANS IN ENDLESS RIBBON CASSETTES

FIELD OF THE INVENTION

The invention relates to an arrangement in typewriters and the like, where a printing ribbon is led over at least three guide means having cylindrical guide surfaces, for eliminating stresses in the transverse direction of the ribbon when the ribbon is displaced transversely of its direction of travel at the printing location.

BACKGROUND

Typewriters, line printers and similar printing apparatus are usually provided with ribbons which, by the action of the printing means, apply pigment to the medium on which the pigment is to be printed. Ribbons with black and red pigment have been used for a long time. Demands for the availability of printing with several colors has led to wider ribbons, where the pigments are disposed as bands along the ribbon. For printing is a given color, the ribbon is raised or lowered in relation to the printing means at the printing location. The ribbon is led from a storage region to the printing location and from there back again to the storage region with the aid of guide means for keeping the ribbon in position at right angles to its direction of travel, and guiding means for changing the direction of the ribbon. To avoid shear stresses in the transverse direction of the ribbon, the cylindrical surfaces of the guiding means engaging the ribbon must be oriented at rightangles to the plane in which the ribbon is advanced.

A known method of solving the problem mentioned is to turn the ribbon magazine with its guide and guiding means about an axis in the plane of the magazine for printing at different ribbon levels. Other ways are to guide the ribbon over a plurality of guiding rollers mounted on pivotable arms, or to form the guiding means with concave or convex contours. All these solutions result in mechanically complicated arrangements.

SUMMARY OF THE INVENTION

The present invention solves the mentioned difficulties by pivotally mounting the guiding means, with the aid of which the direction of the ribbon is changed, such that forces in the transverse direction of the ribbon are eliminated.

In accordance with the invention, there is provided a pivotally mounted guide means in an endless ribbon cassette which has a ribbon magazine with opposite cover plates and an end wall between the cover plates. The guide means is pivotally mounted in the cassette between the cover plates in a space in the end wall and the guide means comprises a substantially cylindrical body having a longitudinal axis and a longitudinal slot therein for receiving an edge portion of the end wall which bounds the space therein. The cylindrical body has an outer cylindrical surface on which the ribbon passes during ribbon travel. The body has a surface at the bottom of the slot with a portion in pivotal contact with the edge portion of the end wall and wherein one of said portions includes two sloped surfaces which intersect along a line midway between end surfaces of the cylindrical body. The line of intersection of the two sloped surfaces, constitutes a pivot axis for said cylindrical body on said edge portion of said end wall. The end surfaces of the cylindrical body are confined between the cover plates for limiting longitudinal movement of the body between the cover plates. The edge portion of the end wall is fitted in said slot and prevents turning of the guide body around the longitudinal axis thereof.

BRIEF DESCRIPTION OF THE FIGURES OF THE DRAWING

The invention will be described in detail in conjunction with the accompanying drawings, wherein FIG. 1 schematically illustrates the parts of a typewriter which are of interest for explaining the invention;

FIG. 3A is a front elevational view of a guide roller according to a first embodiment of the invention;

FIG. 3B is a transverse sectional view of the guide roller;

FIG. 3C shows the guide roller in operation;

FIG. 3D is an end view of the guide roller;

FIG. 4A is a front elevational view of another embodiment of the guide roller;

FIG. 4B is a transverse sectional view of the guide roller in FIG. 4A in dissassembled state;

FIG. 4C shows the assembled state of the guide roller in FIG. 4B; and

FIG. 4D is an end view of the dissassembled guide roller.

DETAILED DESCRIPTION OF EMBODIMENTS FOR CARRYING OUT THE INVENTION

Figure 1:
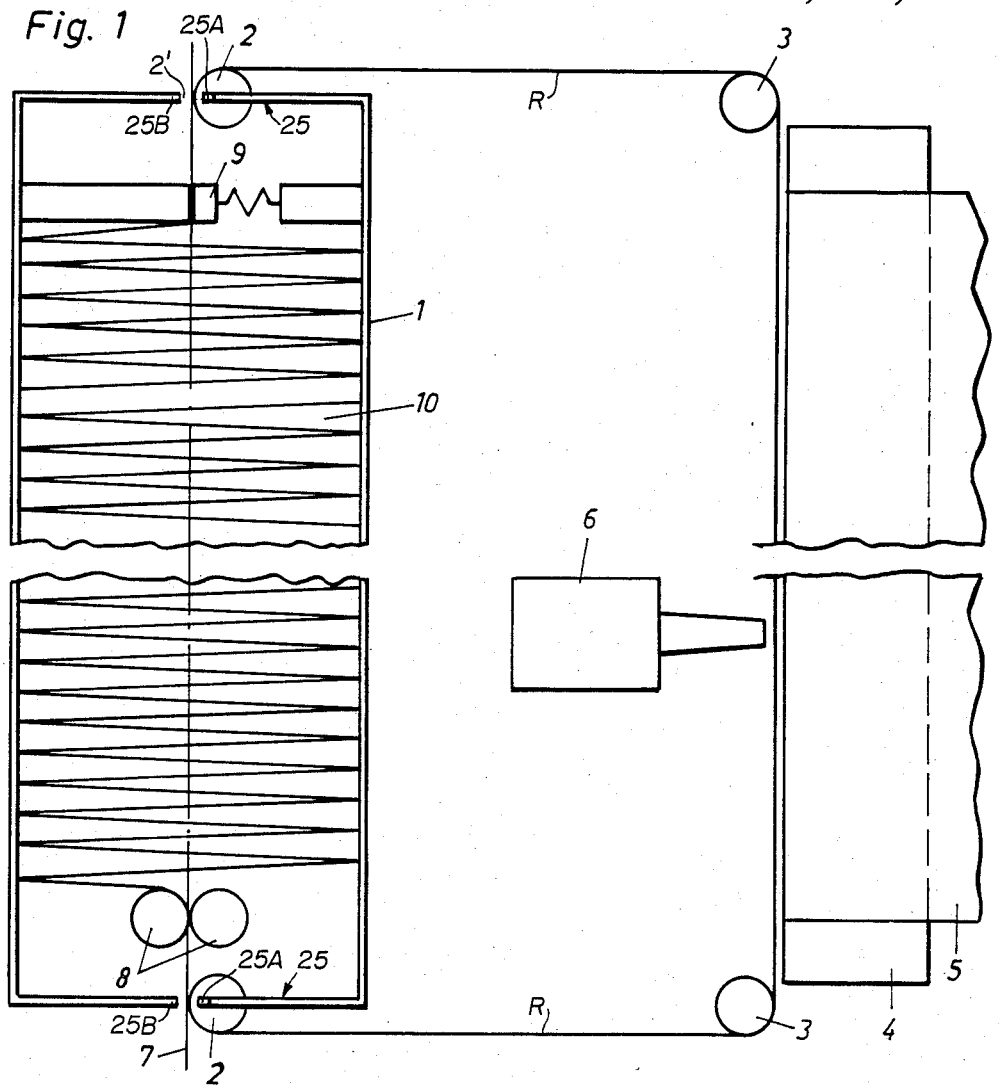

FIG. 1 schematically illustrates the parts of a typewriter, and especially a cassette therefore, of interest for explaining the invention. A ribbon magazine 1, known per se, with ribbon storage 10, feed wheels 8 and ribbon brake 9 is provided with two guiding means 2 constructed in accordance with the invention. Two further guiding means 3, constructed in accordance with the invention, guide the ribbon R between the paper 5 and the printing means 6 of the typewriter parallel to a platen 4. The guiding means 3 are raisable and lowerable in relation to the printing means 6 to enable the use of different bands (not shown), e.g. different colors, in the transverse direction of the ribbon R.

Figure 2:
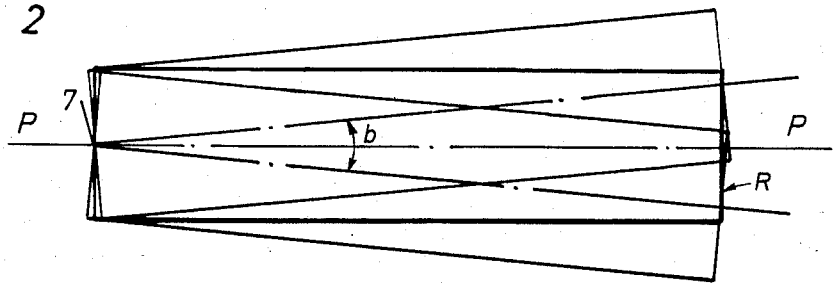
FIG. 2 is a side view of the ribbon path.

FIGS. 3A–3D illustrate one embodiment of the guiding means 2, which comprises a generally cylindrical body 20 provided with a longitudinal slot 26. The slot **2*b* has parallel walls 41, 42 and sloping bottom surfaces 43, 44 which intersect at line 24 midway between the end surfaces 45, 46 of the cylinder. The angle $\alpha$ formed by the sloping bottom surfaces 43, 44 with respect to each other is greater than the turning angle b (FIG. 2) within which the plane P of the ribbon R is intended to move. The guiding means 2 coacts with an end wall or plate 25 arranged between two cover plates 22 and 23 of magazine 1 such that the intersection line 24 between the sloping bottom surfaces 43, 44 of the slot 26 constitutes an axis about which the guiding means 2 may be pivoted on wall 25. The body 20 is fitted in a space 21 formed in wall 25 with the axis 24 bearing against the wall 25 at one edge 25A of the space 21 and with the other edge 25B of the space 21 proximate the periphery of body 20. The end surfaces 45, 46 of the guiding means 2 are cylindrically formed, with the axis 24 as their central axis and the body 20 is limited in axial movement between cover plates 22 and 23, whereby the position of the axis 24 in relation to the cover plates 22 and 23 is retained when the guiding means 2** is pivoted.

FIGS. 4A–4D illustrate an embodiment of the guiding means 3. Therein, the guiding means comprises a generally cylindrical body 31 provided with a longitudinal slot 32. The essential difference between the embodiment of FIGS. 4A–4D and the embodiment illustrated in FIGS. 3A–3D is that the guiding means 3 is pivoted about a pin 27 fixed to a rod 29 in the slot 32. In this embodiment, the guiding means 3 is also provided with upper and lower flanges 28 for guiding the ribbon R. Of course, the guiding means 2 according to FIGS. 3A–3D may also be provided with flanges for guiding the ribbon in its transverse direction, just as well as the guiding means 3 of FIGS. 4A–4D may lack such flanges. With the magazine 1 in a stationary position in the typewriter, the ribbon R is advanced in a plane P (FIG. 2) which pivots about an axis 7 for raising or lowering the ribbon R at the printing location. The axis 7 is at the center line of the ribbon R where the ribbon R leaves the magazine 1. For enabling such pivoting of the ribbon plane P without developing shear stresses in the ribbon R, the pivot axes of the guiding means 2 and 3 (i.e. axis 24 in FIGS. 3A–3D and pin 27 in FIGS. 4A–4D respectively) are mounted in the plane P of the ribbon path, and are parallel to the axis 7. Due to the tension in the ribbon R, the guiding means 2, 3 will thus automatically adjust themselves such that a generatrix of the cylindrical surfaces of body 20 over which the ribbon R runs will be at right angles to the plane P of the ribbon path. This means that bending moments acting on the ribbon R between guiding means 2 and 3 are translated into turning moments between one of the guiding means 2 and the feed wheels 8 as well as between the other guiding means 2 and the ribbon brake 9.

I claim:

1. Pivotally mounted guide means for an endless ribbon cassette having a ribbon magazine with opposite cover plates and an end wall between the cover plates, said guide means being pivotally mounted between the cover plates in a space in the end wall, said guide means comprising a substantially cylindrical guide body having a longitudinal axis and a longitudinal slot therein for receiving an edge portion of the end wall which bounds the space therein, said body having an outer cylindrical surface on which the ribbon passes during ribbon travel, said body having a surface at the bottom of the slot with a portion in pivotal contact with said edge portion of the end wall and wherein one of said portions includes two sloped surfaces which intersect along a line midway between end surfaces of the cylindrical body, said line of intersection of said two sloped surfaces constituting a pivot axis for said body on said edge portion of said end wall, said end surfaces of said body being confined between the cover plates for limiting longitudinal movement of the body between the cover plates, said edge portion of the end wall being in said slot and preventing turning of the guide body around the longitudinal axis thereof.

2. Guide means as claimed in claim 1 wherein said end surfaces of said body are cylindrical and have a common center on said longitudinal axis of said body.

3. Guide means as claimed in claim 1 wherein said sloped surfaces are formed on said body at the bottom of said slot.

4. Guide means as claimed in claim 3 wherein said sloped surfaces project into said slot.

5. Guide means as claimed in claim 1 wherein the other of said portions, which contacts the pivot axis formed by said sloped surfaces, is planar.

6. Guide means as claimed in claim 1 wherein said slot has opposite flat longitudinal surfaces between which said edge portion of said end wall is fitted.

* * * * *